United States Patent [19]

Whitney et al.

[11] Patent Number: 4,664,280

[45] Date of Patent: May 12, 1987

[54] COMPOSITE CLOSURE

[75] Inventors: Ralph H. Whitney; Sheldon L. Wilde; John R. Schetzsle; Daniel G. Denman, all of Crawfordsville, Ind.

[73] Assignee: H-C Industries, Inc., Crawfordsville, Ind.

[21] Appl. No.: 814,068

[22] Filed: Dec. 20, 1985

Related U.S. Application Data

[63] Continuation-in-part of Ser. No. 723,858, Apr. 16, 1985, abandoned.

[51] Int. Cl.[4] ..... B65D 53/04

[52] U.S. Cl. ..... 215/350

[58] Field of Search ..... 215/350

[56] References Cited

U.S. PATENT DOCUMENTS

| | | | |
|---|---|---|---|
| 2,068,389 | 1/1937 | Smith | 215/350 |
| 3,189,209 | 6/1965 | Owens | 215/350 X |
| 4,407,422 | 10/1983 | Wilde et al. | 215/350 X |

OTHER PUBLICATIONS

Scale representation of plastic closure having outer shell and liner adjacent top wall of shell, partially cutaway; 1 page, FIGS. 1 and 2.

*Primary Examiner*—Donald F. Norton

*Attorney, Agent, or Firm*—Dressler, Goldsmith, Shore, Sutker & Milnamow, Ltd.

[57] ABSTRACT

A composite closure for a container is disclosed which includes an outer plastic cap and an inner plastic sealing liner. Formation and retention of the sealing liner within the cap is promoted by the provision of an annular liner-retaining lip which extends inwardly from a skirt portion of a cap in closely spaced relation to its top wall portion, and thus defines an annular recess therewith, Liner retention is further enhanced by the provision of a plurality of circumferentially spaced first liner-engaging projections which are arranged in adjacent pairs within the annular recess of the cap in converging relation with each other. Liner retention is further enhanced by the preferred provision of a plurality of second circumferentially spaced liner-engaging projections extending integrally from the top wall portion of the cap in operative association with the converging adjacent pairs of the first projections.

18 Claims, 5 Drawing Figures

COMPOSITE CLOSURE

CROSS-REFERENCE TO RELATED APPLICATION

The present application is a continuation-in-part of application Ser. No. 723,858, filed Apr. 16, 1985, now abandoned.

TECHNICAL FIELD

The present invention relates generally to closures for bottles and like containers, and more particularly to a composite closure including a plastic cap and a plastic sealing liner configured to enhance mechanical retention of the liner within the plastic cap.

BACKGROUND OF THE INVENTION

Commonly assigned U.S. Pat. Nos. 4,343,754, 4,378,893, 4,418,828, 4,407,422, and 4,497,765 disclose constructions for, and methods and apparatuses for making, composite closures for bottles and like containers. The closures are composite in the sense that they include an outer plastic cap or shell, and a plastic sealing liner positioned adjacent a top wall portion of the plastic cap for effecting sealing engagement with an associated container. By such a construction, the plastic material of the outer cap can be selected to exhibit the requisite strength, while the material for the inner sealing liner can be relatively soft for enhanced sealing with the finish of a container. Significantly, composite closures formed in accordance with the teachings of the above patents have proven highly effective for use on containers having pressurized or carbonated contents, with the above patents further disclosing tamper-indicating closure pilfer band constructions for indicating removal of a closure from a container. Portions of the above patents not inconsistent with the present disclosure are hereby incorporated by reference.

One aspect of the composite closure constructions of the above patents which promotes effective sealing is the formation of the sealing liner with a relatively thick annular sealing bead portion which defines a generally inwardly facing sealing surface. Formation is facilitated by molding the outer plastic cap with an annular liner-retaining lip in closely spaced relation to the top wall portion of the cap, with the annular lip desirably acting to confine the material from which the liner is formed during in situ formation of the liner, preferably in accordance with the compression molding techniques disclosed in the above patents.

While the annular lip acts to retain the liner in position within the cap after formation, liner retention is desirably enhanced by the formation of liner-engaging projections integrally with the top wall portion of the cap. In accordance with the teachings of U.S. Pat. No. 4,407,422 and 4,497,765, formation of a plurality of circumferentially spaced liner-engaging projections extending integrally from the top wall portion in close association with the annular liner-retaining lip desirably acts to mechanically retain the peripheral edge portion of the sealing liner, thus retaining the liner in position. Such circumferentially spaced liner-engaging projections can be partially disposed within the annular recess defined by the annular lip and the top wall portion, and are preferably arranged to engage the relatively thick annular sealing bead portion of the liner.

While the above-described sealing construction has proven effective for use on containers having carbonated contents, experience has shown that enhanced liner retention can be desirable for some applications. As will be appreciated, the liner of a closure is subjected to torsional stresses attendant to application to, removal from, and re-application to a container, and it is generally desirable to avoid dislodgement of the liner when it is subjected to such stresses. While the above-described arrangement of circumferentially spaced liner-engaging projections provides highly effective liner retention with many liner materials, such materials can vary in hardness and like physical characteristics, thus affecting the liner retention characteristics of the liner-engaging projections and annular lip. While increasing the dimensions of the circumferentially spaced liner-engaging projections can act to enhance liner retention, it is desirable that the projections not be so large as to interfere with distribution of the liner material during liner formation, or extend through the liner material after the liner is formed. Accordingly, the present invention concerns an improved liner retaining construction for a composite closure including a plastic cap and a plastic sealing liner.

SUMMARY OF THE INVENTION

In accordance with the present invention, a composite closure is disclosed which includes an outer plastic cap and an inner plastic sealing liner. The plastic cap of the closure is preferably of the above-described type, and includes an annular liner-retaining lip in closely spaced relation to a top wall portion of the cap thereby defining an annular recess therewith. Significantly, the closure cap further includes a plurality of integral liner-engaging projections at least partially disposed in the annular recess of the cap, and which extend inwardly from the junction of the annular lip and the top wall portion. The projections are preferably arranged in adjacent pairs which are in converging relation to each other. Each closely spaced adjacent pair of projections is thus arranged in a "dovetail" configuration for mechanically entrapping and confining an annular edge portion of the associated sealing liner between the adjacent pair of projections, and thus effects a liner gripping action in a generally radial direction relative to the axis of the closure.

The outer plastic cap of the present closure includes a top wall portion, and an integral depending annular skirt portion which is preferably provided with an integral internal thread formation for coaction with a like thread formation on the neck of an associated container. The plastic cap can be formed with an integral tamper-indicating pilfer band if desired.

The plastic cap further includes an inwardly extending, annular liner-retaining lip which extends inwardly from the skirt portion of the cap in closely spaced relation to the top wall portion, and thus defines an annular recess with the top wall portion. The present closure further includes a plastic sealing liner positioned adjacent the top wall portion of the closure cap for effecting sealing engagement with an associated container. The sealing liner preferably includes a relatively thick annular sealing bead portion which extends into the annular recess of the closure cap, and which preferably defines a generally inwardly facing sealing surface.

In accordance with the present invention, the plastic cap of the closure includes a plurality of circumferentially spaced liner-engaging projections positioned at least partially within the annular recess of the plastic cap, with the projections extending integrally inwardly from the junction of the annular lip and the top wall portion of the closure. In one disclosed embodiment, these projections are generally web-like in configuration, and extend vertically between generally opposed surfaces of the annular lip and the top wall portion. In another embodiment, the projections are detached from the annular lip, and thus each projection has a free edge spaced from and generally facing a surface of the annular lip which is generally opposed to the top wall portion.

Significantly, all of the liner-engaging projections are preferably arranged in adjacent pairs, wherein the projections of each adjacent pair are arranged in converging relation to each other. By this construction, an edge portion of the sealing liner is confined between each pair of the converging projections, thus providing highly effective retention of the sealing liner in position within the plastic cap adjacent the top wall portion.

In the presently preferred form, the above-described converging pairs of liner-engaging projections comprise first liner-engaging projections, with the plastic cap further including a plurality of circumferentially spaced second liner-engaging projections extending integrally from the top wall portion of the cap in operative association with the first projections. The second projections are preferably arranged to engage the relatively thick annular sealing bead portion of the sealing liner, and are positioned in close association with the annular lip of the closure cap. The second liner-engaging projections can be partially or completely disposed within the annular recess of the cap. In the preferred form, at least some of the second projections are arranged in closely-spaced relation to and generally circumferentially intermediate of respective adjacent pairs of the converging first projections, thus cooperating with the first projections for further enhancing the liner retention characteristics of the construction.

The desired liner-retention characteristics of the present closure are enhanced by configuring the converging surfaces of each pair of first projections to be non-radial with respect to the closure, i.e., each first projection is arranged at an acute angle to a line tangential to the base of the projection and the closure.

Other features of the present invention will become readily apparent from the following detailed description, the accompanying drawings, and the appended claims.

DETAILED DESCRIPTION

Figure 1:
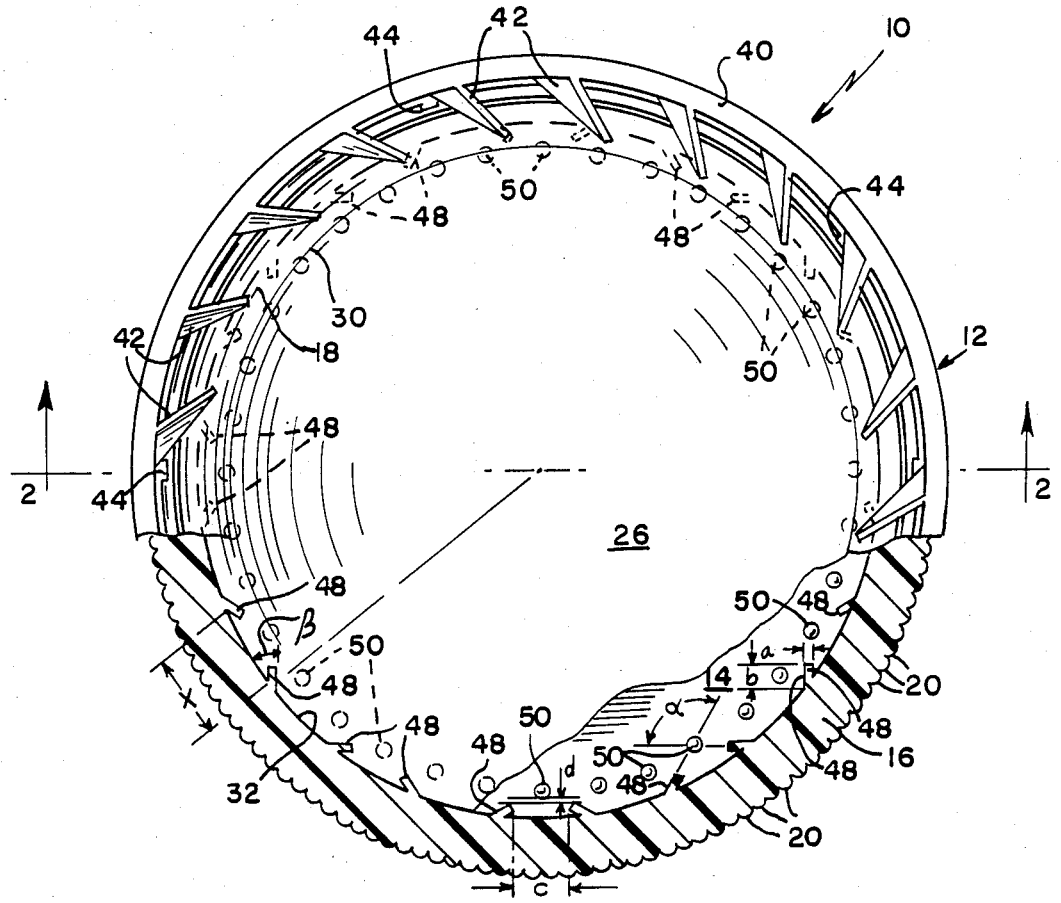
FIG. 1 is a top plan view of a composite closure embodying the principles of the present invention, with portions of the closure shown in cut away and cross-section.

While the present invention is susceptible of embodiment in various forms, there is shown in the drawings and will hereinafter be described first and second alternate embodiments thereof, with the understanding that the present disclosure is to be considered as an exemplification of the invention, and is not intended to limit the invention to the specific embodiments illustrated.

Figure 2:
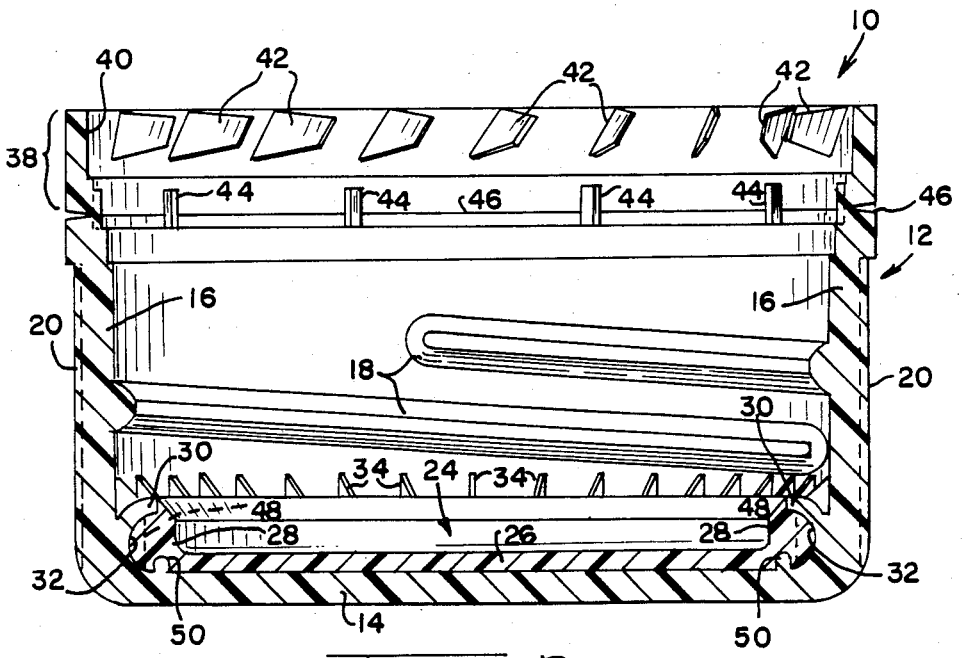
FIG. 2 is a cross-sectional view of the present closure taken generally along line 2—2 of FIG. 1.
Figure 3:
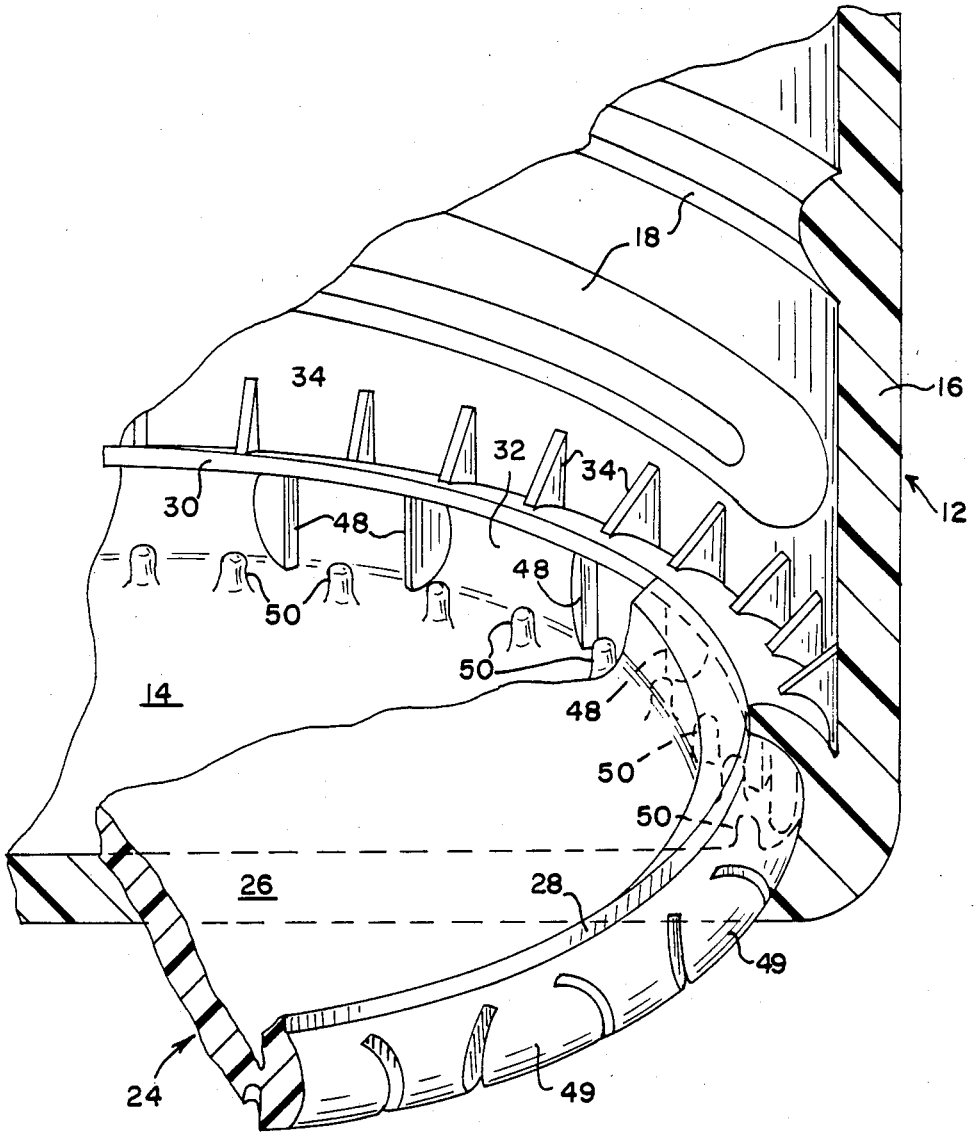
FIG. 3 is an enlarged perspective view illustrating the configuration of the outer plastic cap of the present closure for effecting liner retention.

With reference first to FIGS. 1-3, therein is illustrated a first embodiment of a composite closure 10 embodying the principles of the present invention. Closure 10 includes a cup-like plastic closure cap or shell 12 having a top wall portion 14 and a generally cylindrical, depending annular skirt portion 16 integral with top wall portion 14. An internal thread formation 18 is provided on the inside of skirt portion 16, and is adapted to cooperate with a like thread formation on a container to which the closure is applied. The exterior of the skirt portion 16 is preferably provided with a plurality of circumferentially spaced finger ribs 20 to facilitate manipulation of the closure. Cap 12 is preferably made of moldable thermoplastic, such a polypropelyene or polyethylene. Formation of cap 12 can be very efficiently effected by compression molding techniques in accordance with the teachings of U.S. Pat. Nos. 4,343,754 and 4,497,765, but a closure embodying the principles disclosed herein can be otherwise formed.

Closure 10 is of the so-called composite type, and includes a plastic sealing liner 24 disposed adjacent top wall portion 14. Liner 24 (shown partially cut away in FIGS. 1 and 3) includes a disk-shaped central portion 26, and a relatively thick annular sealing bead portion 28. The annular sealing bead portion 28 is configured to define a generally inwardly facing sealing surface (shown as comprising adjacent generally cylindrical and frusto-conical surfaces), with the liner 24 thus arranged to effect a so-called "top/side seal" with an associated container. Liner 24 is preferably made of moldable thermoplastic, such as polyvinylchloride (PVC).

Secure retention of sealing liner 24 within cap 12 promotes proper sealing of a container to which the closure is fitted. To this end, cap 12 is formed with an annular liner-retaining lip 30 extending integrally inwardly from skirt portion 16. Annular lip 30 is positioned in closely spaced relation to top wall portion 14, and thus defines an annular recess 32 within which at least a portion of bead portion 28 of liner 24 is positioned. A plurality of circumferentially spaced reinforcing gussets 34 can be provided extending integrally between skirt portion 16 and lip 30 for reinforcing the lip. Annular lip 30 not only acts to retain sealing liner 24 in position within cap 12, but further promotes in situ formation of liner 24, such as by compression molding of the liner, by confining the moldable liner material during liner formation.

Closure 10 is illustrated as including a pilfer band 38 which may be optionally formed integrally with cap 12. Pilfer band 38 includes an annular band portion 40, and a plurality of circumferentially spaced, relatively flexible wings or projections 42 integral with band portion 40. Wings 42 are adapted to coact with an annular locking ring typically provided on the neck of the container to resist removal of the closure from the container, and thereby at least partially detaching pilfer band 38 from skirt portion 16 for indicating closure removal. A fracturable connection between the pilfer band 38 and the skirt portion 16 can be very efficiently formed by the provision of circumferentially spaced ribs 44 which extend between the inside surfaces of band portion 40 and skirt portion 16. The fracturable connection is further provided by partially or completely circumferentially scoring the closure at 46, thereby distinguishing the pilfer band from the skirt portion and preferably partially cutting the ribs 44 whereby the ribs are frangible for detachably joining the pilfer band to the skirt portion. A closure including a pilfer band as illustrated can be formed in accordance with the teachings of U.S. Pat. Nos. 4,418,828 and 4,497,765.

In accordance with the present invention, secure retention of the sealing liner 24 within plastic cap 12 is enhanced by the provision of a plurality of circumferentially spaced, first liner-engaging projections 48 positioned within the annular recess 32 of the closure cap 12. Projections 48 are each of a generally web-like configuration, and extend integrally inwardly of the closure generally from the junction of annular lip 30 with top wall portion 14. For purposes of the present disclosure, the junction of annular lip 30 and top wall portion 14 can be considered to be that region of the closure cap where annular recess 32 has its maximum internal diameter. As illustrated, the projections 48 extend vertically generally between the top wall portion and the annular lip, and thus, the free edges of projections 48 are spaced from the inner edge of annular lip 30 where the lip 30 merges into and joins top wall portion 14.

Significantly, all of the liner-engaging projections 48 are preferably arranged in adjacent pairs wherein the projections of each adjacent pair are arranged in converging relation to each other whereby they cooperate to mechanically entrap and confine an edge portion 49 of annular sealing bead 28 of sealing liner 24. By this converging configuration of the projections 48, a "dovetail"-like region is defined between each adjacent pair, with portions 49 (FIG. 3) of liner 24 between adjacent pairs of projections 48 likewise having such a dovetail configuration attendant to in situ formation of the liner. By this arrangement, it will be noted that each projection 48 is arranged in diverging relation to the adjacent projection 48 of the immediately adjacent converging pair of projections.

In a current embodiment of the present closure wherein annular recess 32 has a maximum internal diameter of approximately 1.07 inches, adjacent pairs of projections 48 have been provided at 30 degree intervals about the circumference of closure cap 12. Each projection 48 has been formed with a thickness dimension at "a" (FIG. 1) on the order of 0.013 inches, and a maximum length dimension at "b" on the order of 0.035 inches. Spacing between converging projections of each adjacent pair has been provided, on average, at 0.074 inches, as shown at "c" in FIG. 1. Thus, the projections 48 of each adjacent pair are sufficiently closely spaced to mechanically confine the respective liner edge portion 49 therebetween, even though the liner material may be relatively deformable. Thus, a radially-acting gripping action on the liner 24 is effected for secure retention of the liner in position within the closure cap.

The projections 48 of each adjacent pair are arranged to converge at an obtuse angle preferably in the range of 100–130 degrees, with this angle being indicated at "alpha" in FIG. 1, and in a current embodiment being on the order of 120 degrees. Each projection 48 extends non-radially inwardly of closure cap 12, with each projection 48 preferably arranged at an acute angle of approximately 30–45 degress with respect to a line tangential to the base of the projection and the closure cap; this acute angle is shown at "beta" in FIG. 1, and in a current embodiment is on the order of 38 degrees.

It is preferred that a certain relationship be established between the spacing of the converging projections 48, and the dimension of the liner edge portion 49 confined thereby. In this illustrated embodiment, the maximum chordal dimension "x" of the portion 49 (see FIG. 1) confined by a pair of projections 48 is on average 0.110 inches, while the spacing between the inner portions of the projections at "c" is on average 0.074 inches, as noted. Thus, the degree of liner-gripping interference created between the projections and the edge portion of the liner can be calculated as:

$$(x-c)/c=(0.110-0.074)/(0.074)=0.49$$

Since the liner material is relatively soft and deformable, values for the above-described interference greater than 0.35 are presently preferred to inhibit dislocation of the liner 24.

While the provision of liner-engaging projections 48 in adjacent converging pairs provides highly effective retention of sealing liner 24 within plactic cap 12, it is presently preferred to further enhance the liner retention characteristics of the closure by providing a plurality of second liner-engaging projections 50 in operative association with the first converging pairs of projections 48. Second projections 50 extend integrally from top wall portion 14, and in a current embodiment, have been provided at 10 degree intervals about the circumference of closure cap 12, with each projection 50 being generally cylindrical and having a diameter on the order of 0.012–0.016 inches, and a height of approximately 0.025–0.030 inches.

In the preferred form, the second projections 50 are arranged with respect to the converging pairs of first projections 48 such that one of the projections 50 is provided in closely spaced relation to and generally circumferentially intermediate of each converging pair of projections 48. In the above-described current embodiment, the spacing between the projection 50 provided circumferentially intermediate of an adjacent pair of projections 48 is on the order of 0.012 inches as illustrated at "d" in FIG. 1. This arrangement of projections 48 and 50 not only arranges the projections for cooperation for enhancing liner retention, but further provides sufficient spacing between the projections 48 and the projections 50 to facilitate fabrication of suitable molding tooling without compromising the structural integrity of the tooling.

Figure 4:
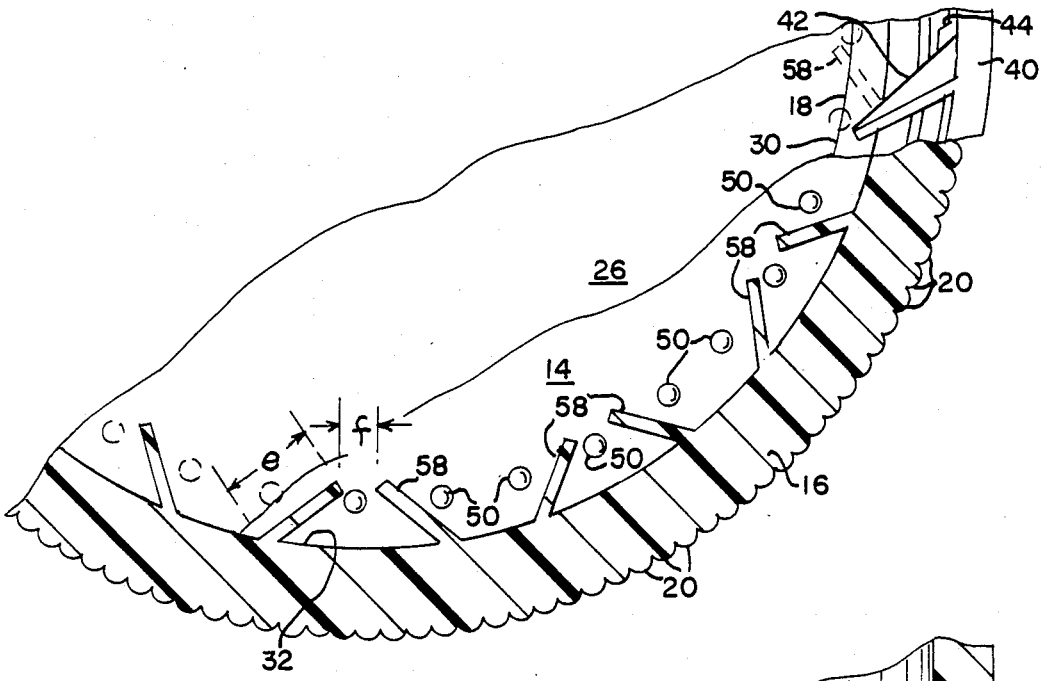
FIG. 4 is a fragmentary view in partial cutaway similar to FIG. 1 illustrating an alternate embodiment of the present invention.
Figure 5:
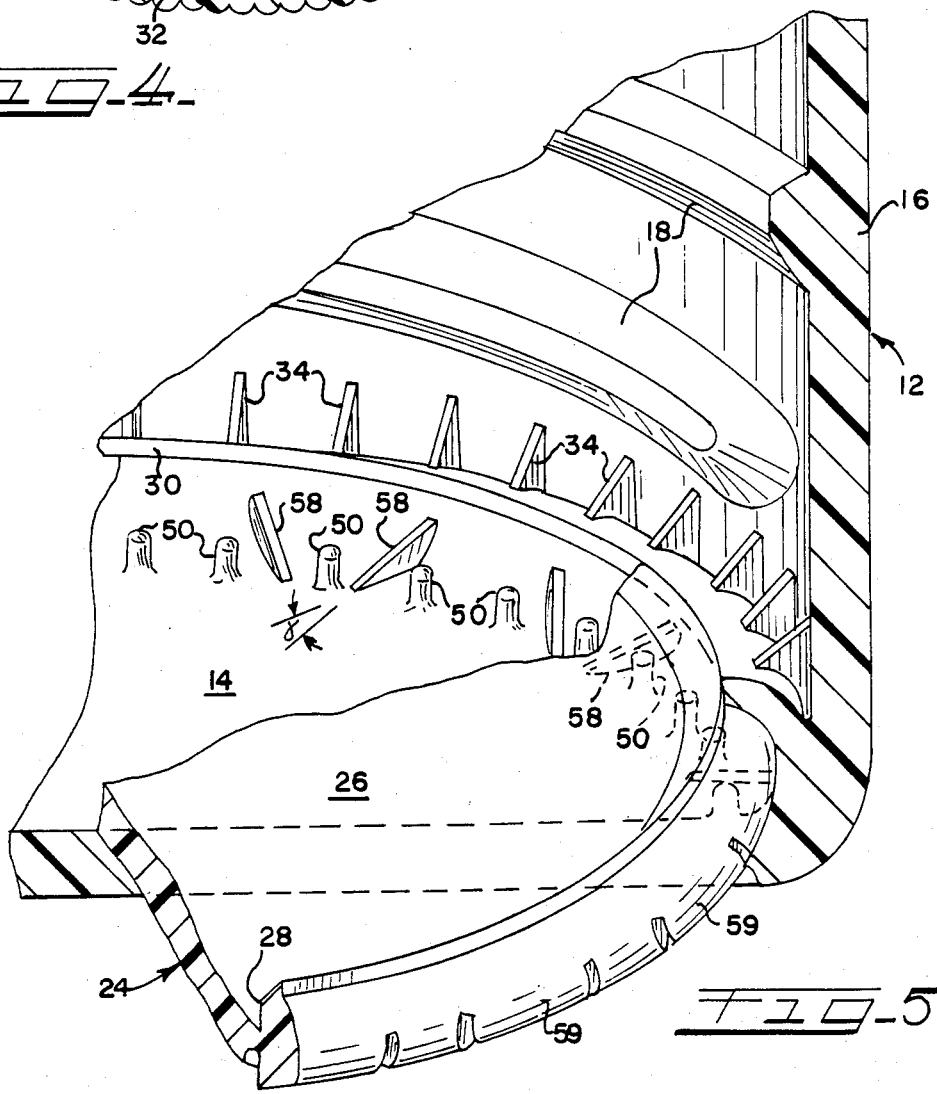
FIG. 5 is an enlarged perspective view similar to FIG. 3 further illustrating the alternate embodiment of the present invention shown in FIG. 4.

Referring now to FIGS. 4 and 5, therein is illustrated a composite closure configured in accordance with an alternate embodiment of the present invention. In most respects, this alternate embodiment is configured in accordance with the previously described embodiment, and thus like reference numerals have been employed. However, it will be observed that in this alternate embodiment, a plurality of first liner-engaging projections 58 are provided which generally correspond in function to previously-described projections 48, but with the projections 58 being differently configured than projections 48.

More specifically, projections 58 are preferably arranged such that each adjacent pair of the projections 58 are disposed in converging relation to each other. By this arrangement, a "dovetail"-like edge portion 59 of sealing liner 24 is disposed between and retained by each converging pair of the projections 58. As in the previously described embodiment, it is presently preferred that first liner-engaging projections 58 be provided for cooperation with a plurality of circumferentially spaced second liner-engaging projections 50, with at least some of the projections 50 positioned in closely spaced relation to and generally circumferentially intermediate of respective ones of adjacent pairs of the first projections 58.

As best illustrated in FIG. 5, it will be observed that while projections 58 extend inwardly of closure cap 12 generally from the junction of annular lip 30 and top wall portion 14, each of the projections 58 is substantially detached from the annular lip 30. Thus, each projection 58 includes a free edge portion which is spaced from and generally faces a surface of lip 30, which said lip surface is generally opposed to top wall portion 14 of closure cap 12.

While projections 58 are intended to effect mechanical retention of an edge portion of sealing liner 24, the manner in which the projections 58 are detached from annular lip 30 facilitates closure manufacture. Specifically, previously-described projections 48, which extend vertically between top wall portion 14 and annular lip 30, to a certain extent act to reinforce and rigidify the annular lip 30, and inhibit flexible movement of the lip 30 in a direction away from top wall portion 14. Such flexible movement of annular lip 30 can be desirable for facilitating removal of closure cap 12 from the male forming plunger with which the cap is formed. Experience has shown that in the event that operation of the apparatus with which closure cap 12 is molded is temporarily interrupted, the plastic material from which the cap is formed can solidify to such an extent that the annular lip 30 cannot be readily deformed a sufficient amount to permit the preferred "stripping" of the closure cap from the male forming plunger. Again, it is believed that the rigidifying effect of previously-described projections 48 exacerbates this phenomenon, and thus, projections 58 of the embodiment of FIGS. 4 and 5 are detached from annular lip 30 to provide the annular lip with desired flexibility in a direction away from top wall portion 14.

In a current embodiment, projections 58 have been arranged to converge at an obtuse angle preferably in the range of 100–130 degrees, (such as indicated at "alpha" in FIG. 1 of the previous embodiment). Each projection 58 extends non-radially inwardly of closure cap 12, with each projection 58 preferably arranged at an acute angle of approximately 30–45 degrees with respect to a line tangential to the base of the projection and the closure cap (such as illustrated at "beta" in FIG. 1 of the previous embodiment).

Projections 58 are preferably provided with a thickness generally on the order of the thickness of previously described projections 48, i.e., on the order of 0.013 inches (note dimension "a" in FIG. 1 of the previous embodiment). However, projections 58 are preferably provided with a substantially greater maximum length dimension as illustrated at "e" in FIG. 5, such as on the order of 0.065 inches. Spacing between converging projections 58 of each adjacent pair has been provided on the order of 0.050 inches, as shown at "f" in FIG. 4.

As best illustrated in FIG. 5, the free edge of each projection 58 in a current embodiment has been formed as generally straight, and is arranged at an acute angle to the surface of top wall portion 14, wherein this angle "gamma" is on the order of 20 degrees. However, it is to be understood that the precise configuration of the projections 58 can be varied in accordance with the teachings herein. The exact shape of the projections in part depends upon the machining technique employed for forming suitable slots in a male molding plunger with which the closure cap is formed, with projections 58 formed in such slots.

From the foregoing, it will be observed that numerous modifications and variations can be effected without departing from the true spirit and scope of the novel concept of the present invention. It is to be understood that no limitation with respect to the specific embodiments disclosed herein is intended or should be inferred. It is, of course, intended to cover by the appended claims all such modifications as fall within the scope of the claims.

What is claimed is:

1. A composite closure, comprising:

a plastic cap having a top wall portion, a depending annular skirt portion, and an annular liner-retaining lip extending inwardly of said skirt portion in spaced relation to said top wall portion to define an annular recess therewith; and a plastic sealing liner positioned adjacent said top wall portion, said plastic cap including a plurality of circumferentially spaced liner-engaging projections in engagement with said sealing liner, said projections being positioned at least partially within said annular recess and extending integrally from the junction of said annular lip and said top wall portion inwardly of said closure, all of said liner-engaging projections being arranged in adjacent pairs, wherein the projections of each said adjacent pair are arranged in converging relation to each other to retain an edge portion of said sealing liner therebetween.

2. A composite closure in accordance with claim 1, wherein said adjacent pairs of projections comprise first liner-engaging projections, said plastic cap including a plurality of circumferentially spaced, second liner-engaging projections extending integrally from said top wall portion in operative association with said adjacent pairs of first projections for retaining and sealing liner in position within said plastic cap.

3. A composite closure in accordance with claim 2, wherein one of said second liner-engaging projections is positioned in closely spaced relation to and generally circumferentially intermediate of each said adjacent pair of said first projections.

4. A composite closure in accordance with claim 1, wherein each said adjacent pair of liner-engaging projections converge at an obtuse angle with respect to each other.

5. A composite closure in accordance with claim 1, wherein each said liner-engaging projection is arranged in diverging relation to the adjacent liner-engaging projection of the immediately adjacent converging pair of said projections.

6. A composite closure in accordance with claim 1, wherein each said liner-engaging projection extends non-radially inwardly of said plastic cap.

7. A composite closure in accordance with claim 1, wherein each said liner-engaging projection extends vertically between generally opposed surfaces of said top wall portion and said liner-retaining lip.

8. A composite closure in accordance with claim 1, wherein each said liner-engaging projection has a free edge spaced from and generally facing a surface of said liner-retaining lip which said lip surface is generally opposed to said top wall portion.

9. A composite closure in accordance with claim 1, wherein each said liner-engaging projection is substantially detached from said liner-retaining lip.

10. A composite closure, comprising:

a plastic cap having a top wall portion, and a depending annular skirt portion having an internal thread formation, and an annular liner-retaining lip extending inwardly of said skirt portion in spaced relation to said top wall portion to define an annular recess therewith; and a plastic sealing liner positioned adjacent said top wall portion, said plastic cap including a plurality of circumferentially spaced first liner-engaging projections, said projections being positioned at least partially within said annular recess and extending integrally inwardly from the junction of said annular lip and said top wall portion, said first projections being arranged in adjacent pairs, wherein the projections of each said adjacent pair are arranged in converging relation to each other to retain an edge portion of said sealing liner therebetween, said plastic cap including a plurality of second liner-engaging projections extending integrally from said top wall portion in operative association with said adjacent pairs of first liner-engaging projections for retaining said sealing liner in position within said plastic cap.

11. A composite closure in accordance with claim 10, wherein one of said second liner-engaging projections is positioned in closely spaced relation to and circumferentially intermediate of each said adjacent pair of said first projections.

12. A composite closure in accordance with claim 10, wherein each said first liner-engaging projection extends vertically between generally opposed surfaces of said top wall portion and said liner-retaining lip.

13. A composite closure in accordance with claim 10, wherein each said first liner-engaging projection is substantially detached from said liner-retaining lip.

14. A composite closure comprising:

a plastic cap having a top wall portion, a depending annular skirt portion, and an annular liner-retaining lip extending inwardly of said skirt portion in spaced relation to said top wall portion to define an annular recess therewith; and a plastic sealing liner positioned adjacent said top wall portion, said plastic cap including a plurality of circumferentially spaced liner-engaging projections in engagement with said sealing liner, said projections being positioned at least partially within said annular recess and extending integrally generally from the junction of said annular lip and said top wall portion inwardly of said closure, each said liner-engaging projection has a free edge spaced from and generally facing a surface of said annular lip which said lip surface is generally opposed to said top wall portion.

15. A composite closure in accordance with claim 14, wherein said liner-engaging projections are arranged in adjacent pairs, wherein the projections of each said adjacent pair are arranged in converging relation to each other to retain an edge portion of said sealing liner therebetween.

16. A composite closure in accordance with claim 15, wherein each said adjacent pair of liner-engaging projections converge at an obtuse angle with respect to each other.

17. A composite closure in accordance with claim 14, wherein said liner-engaging projections comprise first liner-engaging projections, said plastic cap including a pluralty of circumferentially spaced, second liner-engaging projections extending integrally from said top wall portion in operative association with said first projections for retaining said sealing liner in position within said plastic cap.

18. A composite closure in accordance with claim 17, wherein said first liner-engaging projections are arranged in adjacent pairs, wherein the projections of each adjacent pair are arranged in converging relation to each other, at least some of said second liner-engaging projections are positioned in closely spaced relation to and generally circumferentially intermediate of respective ones of said adjacent pairs of said first projections.

* * * * *